US011791578B2

(12) United States Patent
Karita et al.

(10) Patent No.: US 11,791,578 B2
(45) Date of Patent: Oct. 17, 2023

(54) CONNECTOR INCLUDING TERMINALS PROVIDED WITH BOARD CONNECTING PORTIONS

(71) Applicant: SUMITOMO WIRING SYSTEMS, LTD., Mie (JP)

(72) Inventors: Masahiro Karita, Mie (JP); Takashi Tsuchiya, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 81 days.

(21) Appl. No.: 17/474,219

(22) Filed: Sep. 14, 2021

(65) Prior Publication Data

US 2022/0085529 A1 Mar. 17, 2022

(30) Foreign Application Priority Data

Sep. 16, 2020 (JP) ..... 2020-155055

(51) Int. Cl.
*H01R 12/71* (2011.01)
*H01R 12/70* (2011.01)

(52) U.S. Cl.
CPC ..... *H01R 12/707* (2013.01); *H01R 12/716* (2013.01)

(58) Field of Classification Search
CPC .... H01R 12/707; H01R 12/716; H01R 12/57; H01R 12/7052
See application file for complete search history.

(56) References Cited

U.S. PATENT DOCUMENTS

2012/0122347 A1* 5/2012 Aihara ..... H01R 12/707 439/660
2012/0264323 A1* 10/2012 Aihara ..... H01R 12/707 439/345
2017/0324176 A1* 11/2017 Ishikawa ..... H01R 13/6596
2020/0076147 A1* 3/2020 Nakanishi ..... H01R 43/24
2020/0136285 A1* 4/2020 Kitajima ..... H01R 12/716
2020/0194915 A1* 6/2020 Kawashima ..... H01R 12/57
2020/0203864 A1* 6/2020 Hashimoto ..... H01R 12/707
2020/0313353 A1* 10/2020 Kanemura ..... H01R 13/4223
2021/0036444 A1* 2/2021 Sakai ..... H05K 3/3426
2021/0091494 A1* 3/2021 Kitajima ..... H01R 12/707
2021/0098931 A1* 4/2021 Phatiwuttipat ..... H01R 13/506
2021/0104830 A1* 4/2021 Kawashima ..... H01R 12/7023
2021/0259126 A1* 8/2021 Asano ..... H05K 5/0034
2021/0328371 A1* 10/2021 Sakai ..... H01R 13/502
(Continued)

FOREIGN PATENT DOCUMENTS

JP H09-129288 A 5/1997
JP 2011-113801 A 6/2011

*Primary Examiner* — Abdullah A Riyami
*Assistant Examiner* — Nelson R. Burgos-Guntin
(74) *Attorney, Agent, or Firm* — Venjuris, P.C.

(57) ABSTRACT

A connector 10 includes a housing 11 and a plurality of terminals 40A, 40B arranged in two or more stages in a vertical direction in the housing 11. The plurality of terminals 40A, 40B extend downward behind the housing 11 and include board connecting portions 43 in lower end parts. The board connecting portions 43 provided in the plurality of terminals 40A, 40B are so set that the board connecting portions 43 of the terminals arranged in an upper stage (e.g. upper-stage terminals 40A) in the housing 11 are located to be lower in a state before being connected to a surface of a board 100.

5 Claims, 9 Drawing Sheets

(56) References Cited

U.S. PATENT DOCUMENTS

| | | | | |
|---|---|---|---|---|
| 2021/0367368 | A1* | 11/2021 | Miyamura | H01R 13/422 |
| 2022/0085529 | A1* | 3/2022 | Karita | H01R 12/716 |
| 2022/0094089 | A1* | 3/2022 | Takasaki | H01R 13/41 |
| 2022/0216627 | A1* | 7/2022 | Nishitani | H01R 12/58 |
| 2022/0224046 | A1* | 7/2022 | Iida | H01R 13/4364 |
| 2022/0344845 | A1* | 10/2022 | Zhao | H01R 13/516 |

* cited by examiner

CONNECTOR INCLUDING TERMINALS PROVIDED WITH BOARD CONNECTING PORTIONS

CROSS-REFERENCE TO RELATED APPLICATIONS

This application is based on and claims priority from Japanese Patent Application No. 2020-155055, filed on Sep. 16, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. H09-129288 is mounted on a surface of a board. The connector includes a housing and a plurality of terminals (male terminals) to be held in the housing. The respective terminals are arranged in two upper and lower stages in the housing. Each terminal includes a lead portion extending downward behind the housing and a soldered portion to be connected to the board in a lower end part of the lead portion. The soldered portions of the respective terminals are arranged side by side at the same height below the housing. Such a surface mount type connector is also disclosed in Japanese Patent Laid-open Publication No. 2011-113801. Note that, in a case shown in FIG. 3 of Japanese Patent Laid-open Publication No. 2011-113801, parts equivalent to soldered portions of respective terminals are arranged in one stage in a vertical direction in a housing.

SUMMARY

In the case of the above connector, it is required to suppress the occurrence of solder non-wetting by properly controlling a distance between the soldered portions arranged at a higher position than others, out of the soldered portions of the respective terminals, and the surface of the board, i.e. so-called coplanarity.

However, if the housing is deformed by heat during reflow soldering, coplanarity is deteriorated. Particularly, since the terminals are arranged in the two upper and lower stagers in the housing in the case of Japanese Patent Laid-open Publication No. H09-129288, the soldered portions of the terminals in the upper stage may be displaced more upward than the soldered portions of the terminals in the lower stage when the housing is warped. Thus, the control of coplanarity becomes more difficult. In contrast, even if an attempt is made to solve solder non-wetting by increasing a solder thickness, the amount of supplied solder increases, whereby solder paste may protrude between conductive portions to cause a solder bridge during reflow soldering.

Accordingly, the present disclosure aims to provide a connector capable of suppressing variation of coplanarity when terminals are arranged in two or more stages in a vertical direction in housing.

The present disclosure is directed to a connector to be mounted on a surface of a board, the connector including a housing, and a plurality of terminals arranged in two or more stages in a vertical direction in the housing, wherein the plurality of terminals extend downward behind the housing and include board connecting portions in lower end parts, and the board connecting portions provided in the plurality of terminals are so set that the board connecting portions of the terminals arranged in an upper stage in the housing are located to be lower in a state before being connected to the surface of the board.

According to the present disclosure, it is possible to provide a connector capable of suppressing variation of coplanarity when terminals are arranged in two or more stages in a vertical direction in housing.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
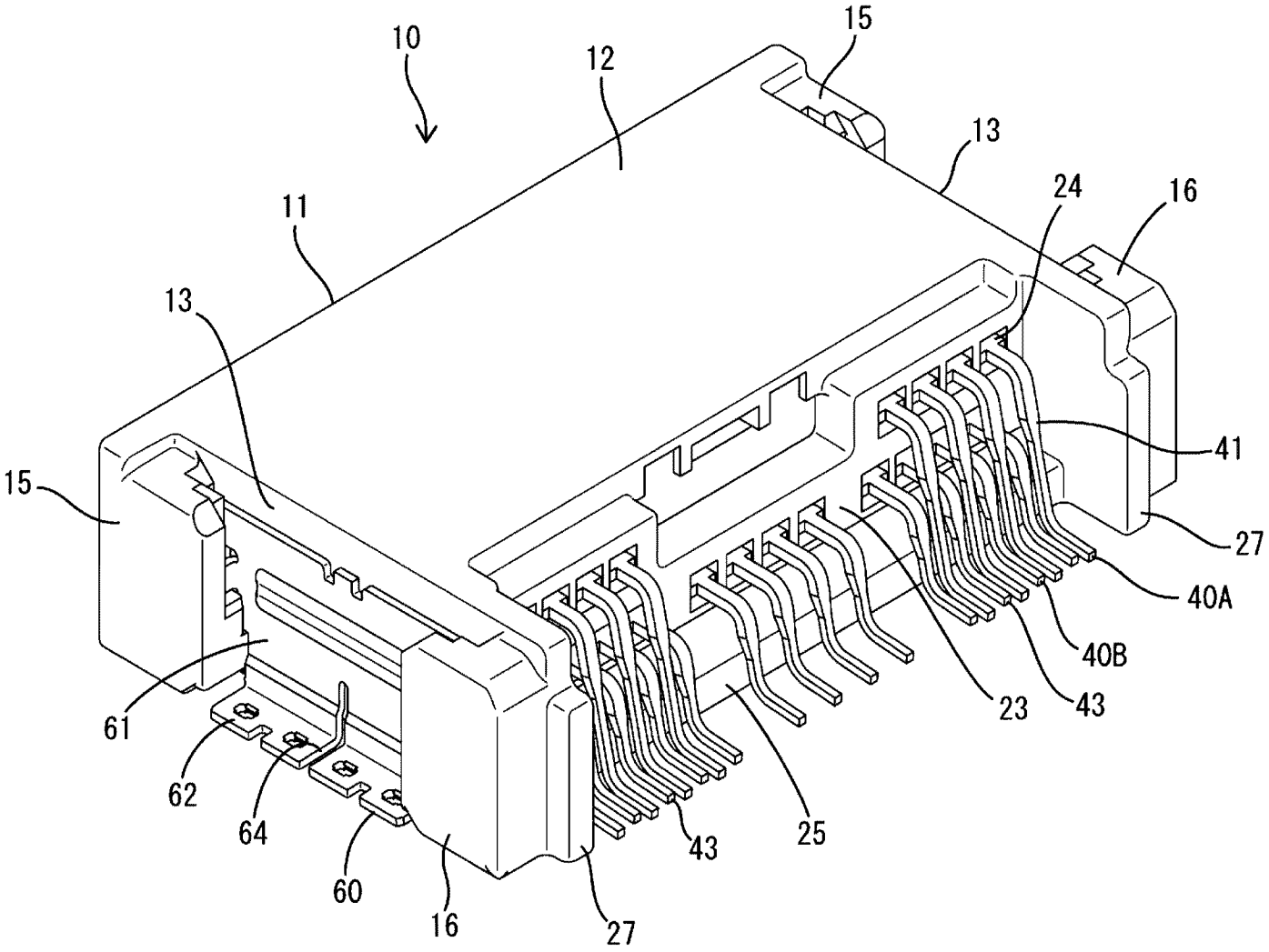
FIG. 1 is a perspective view of a connector in an embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The connector of the present disclosure is a connector to be mounted on a surface of a board and includes a housing, and a plurality of terminals arranged in two or more stages in a vertical direction in the housing, wherein the plurality of terminals extend downward behind the housing and include board connecting portions in lower end parts, and the board connecting portions provided in the plurality of terminals are so set that the board connecting portions of the terminals arranged in an upper stage in the housing are located to be lower in a state before being connected to the surface of the board.

According to the above configuration, if the housing is deformed by heat during reflow soldering, the board connecting portions of the terminals in the upper stage are displaced upward, whereby the board connecting portions of the respective terminals in the upper and lower stages can be aligned at the same height after reflow soldering. Thus, variation of coplanarity can be suppressed also when the terminals are arranged in two or more stages in the vertical direction in the housing.

(2) Preferably, plate-like fixing members are provided which are fixed to the board, a pair of the fixing members are mounted on both widthwise sides of the housing and include each a front end corner portion at a corner part on a front end lower side and a rear end corner portion at a corner part on a rear end lower side, and when the connector is placed on a flat surface before being mounted on the board, the connector is supported on the flat surface with the front end corner portions of the pair of fixing members and the board connecting portions provided in the terminals arranged in the uppermost stage in the housing held in contact with the flat surface.

In the present disclosure, it is required to properly control coplanarity so that the heights of the board connecting portions of the respective terminals are aligned after reflow soldering. In that respect, according to the above configuration, a state where the front end corner portions of the pair of fixing members and the board connecting portions provided in the terminals arranged in the uppermost stage are in contact with the flat surface can be realized when the connector is placed on the flat surface. Thus, a distance from this flat surface to the board connecting portions arranged at a highest position can be properly controlled as coplanarity on the basis of the flat surface at the same height as the front end corner portions of the fixing members.

(3) The front end corner portions may be separated more downward from a bottom surface of the housing than the rear end corner portions in the pair of fixing members.

According to the above configuration, a state where the front end corner portions are in contact with the flat surface can be realized with good reliability when the connector is placed on the flat surface. Thus, the aforementioned coplanarity can be correctly measured on the basis of the position where the front end corner portions of the fixing members are in contact with the flat surface.

(4) The housing may be provided with mounting grooves for the fixing members and front projections and rear projections may be respectively provided before and after the mounting grooves on the bottom surface of the housing, and the front projections may project more from the bottom surface of the housing than the rear projections.

According to the above configuration, if the fixing member is press-fit into the mounting groove of the housing from above with the housing placed on a horizontal support surface or the like, the fixing member can be mounted in a posture inclined downward toward a front side due to a height difference between the front and rear projections. Thus, the front end corner portions of the fixing members can be easily separated more downward from the bottom surface of the housing than the rear end corner portions.

Details of Embodiment of Present Disclosure

A specific example of an embodiment of the present disclosure is described below with reference to the drawings. Note that the present invention is not limited to these illustrations and is intended to be represented by claims and include all changes in the scope of claims and in the meaning and scope of equivalents.

Figure 2:
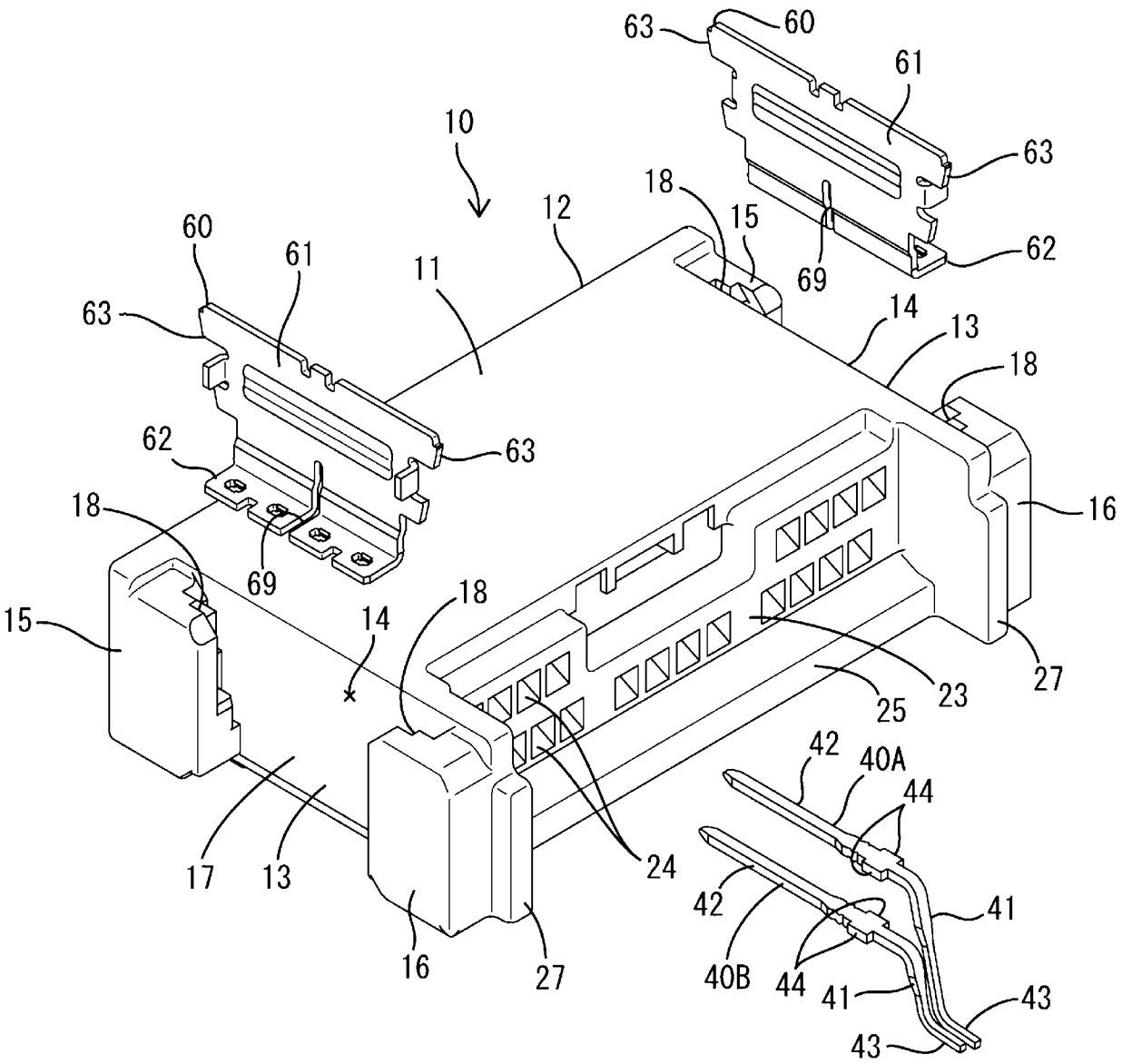
FIG. 2 is an exploded perspective view of the connector.
Figure 6:
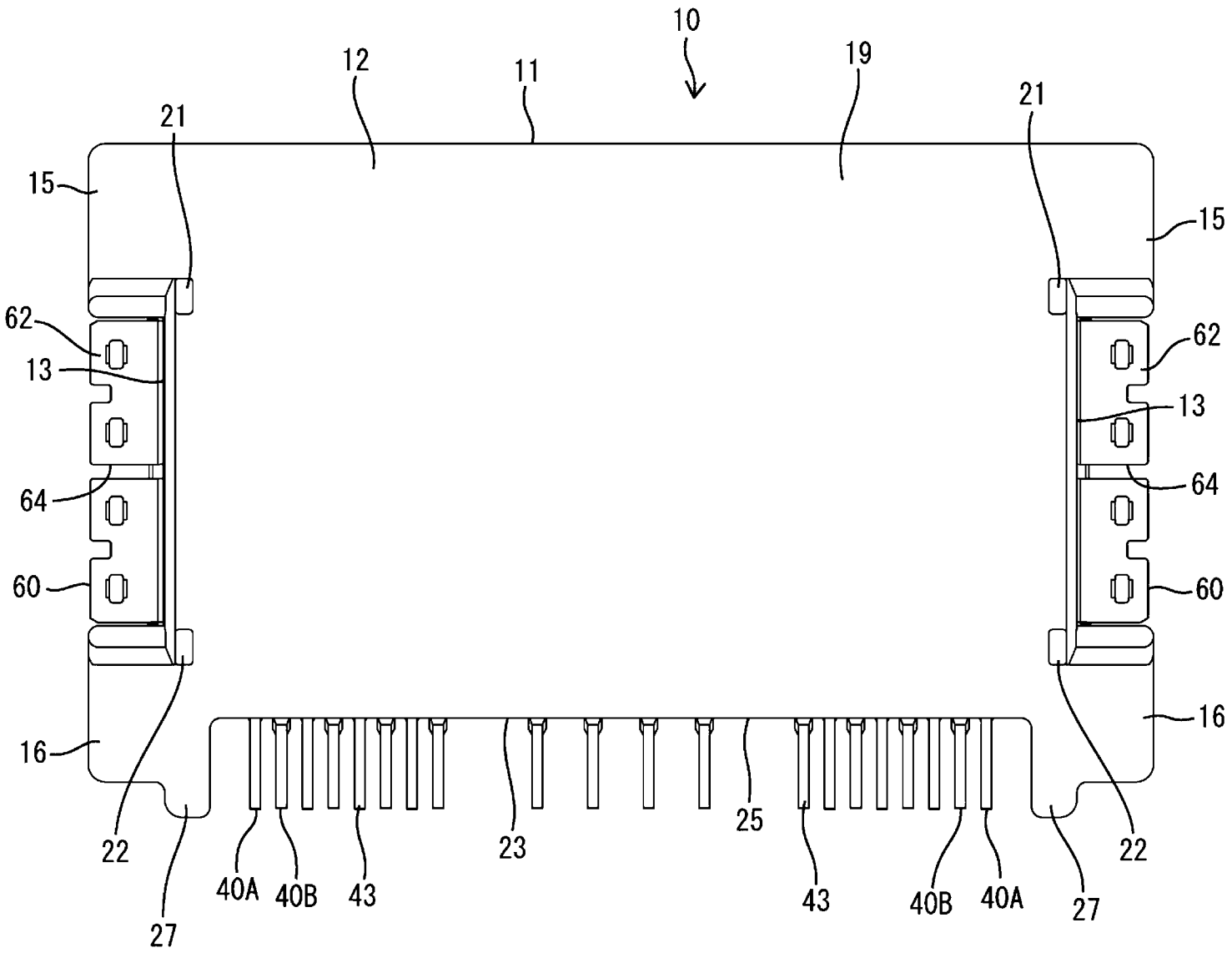
FIG. 6 is a bottom view of the connector.
Figure 7:
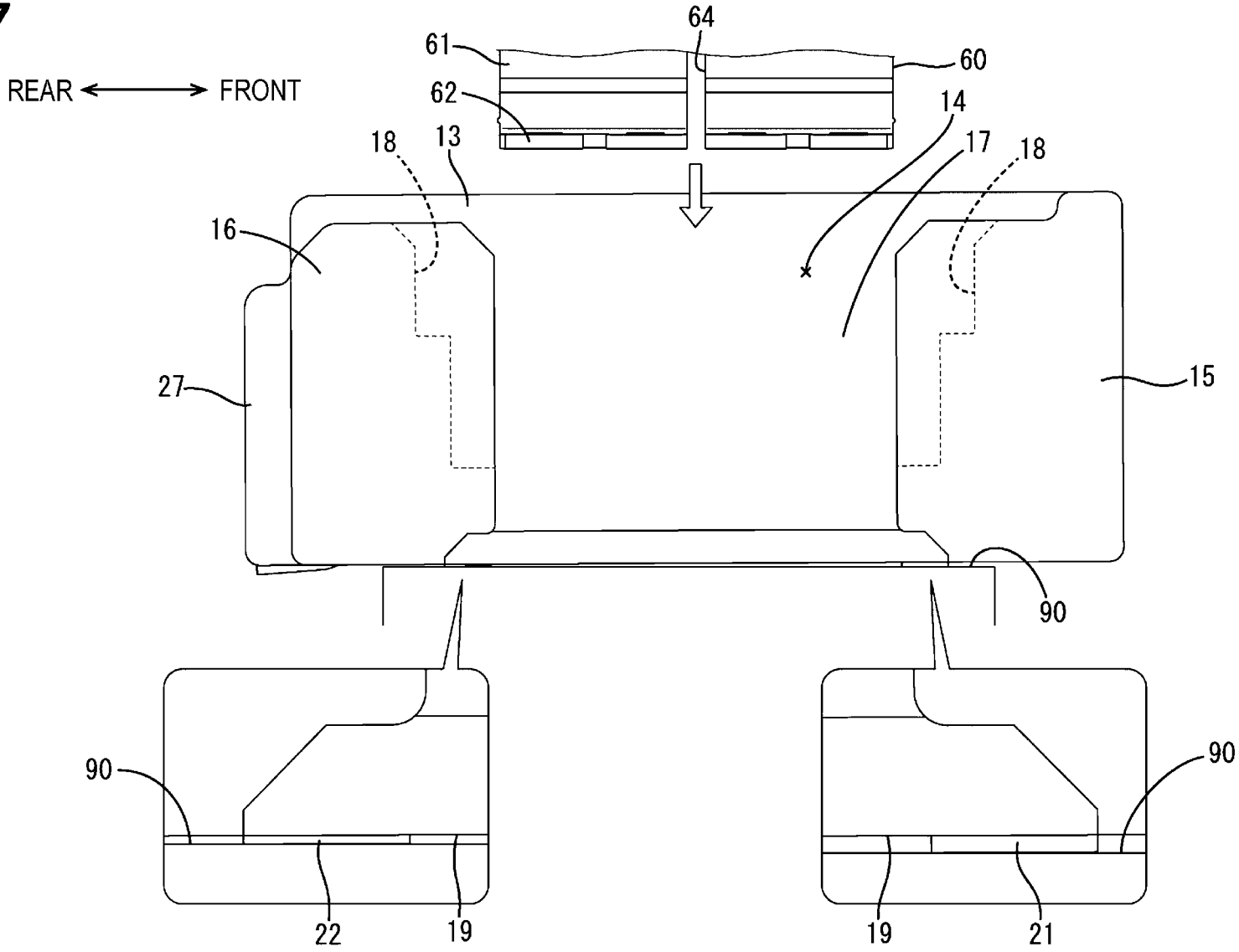
FIG. 7 is a view showing the mounting of a fixing member into a housing.
Figure 8:
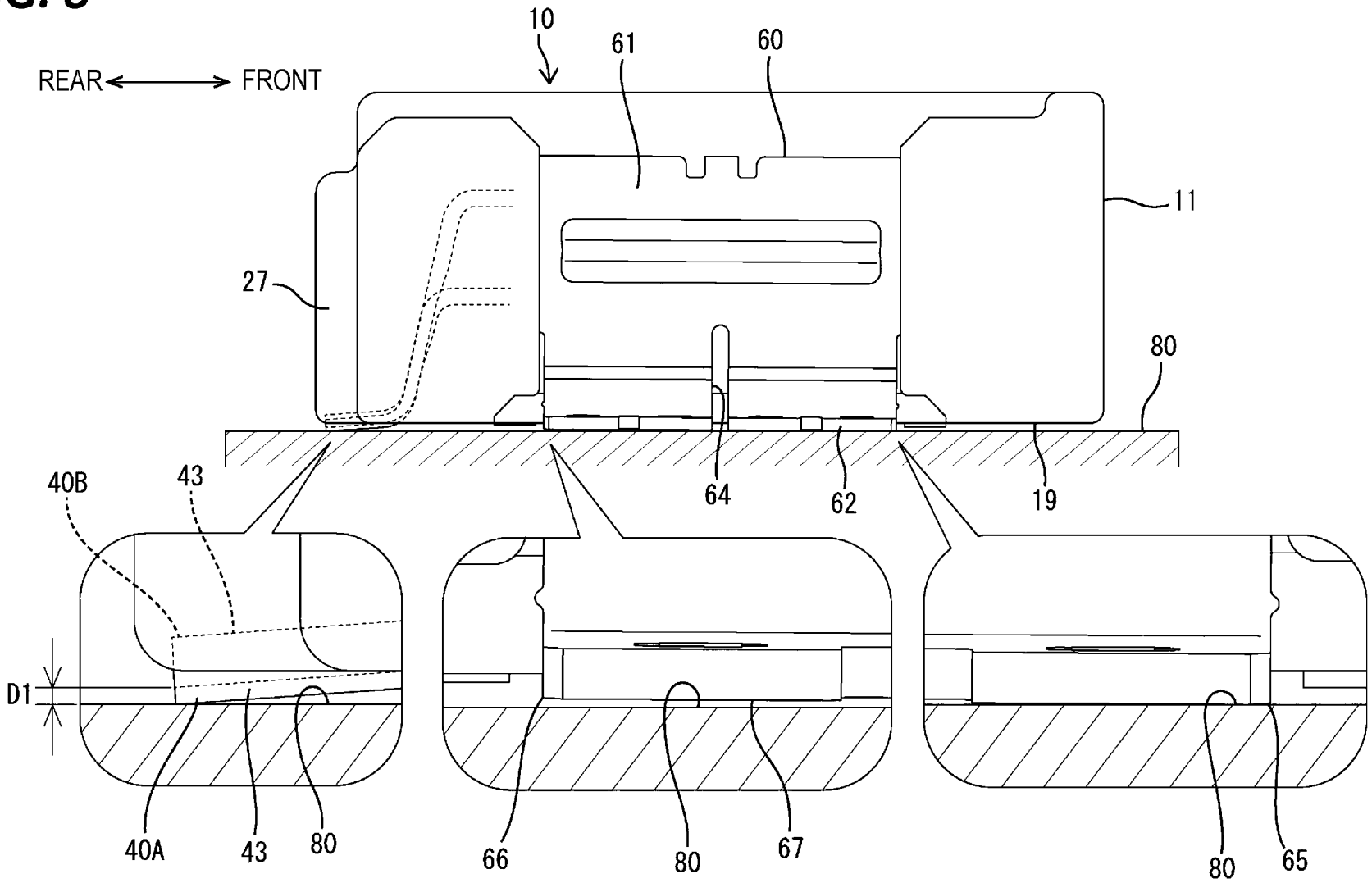
FIG. 8 is a view showing a measurement of coplanarity.
Figure 9:
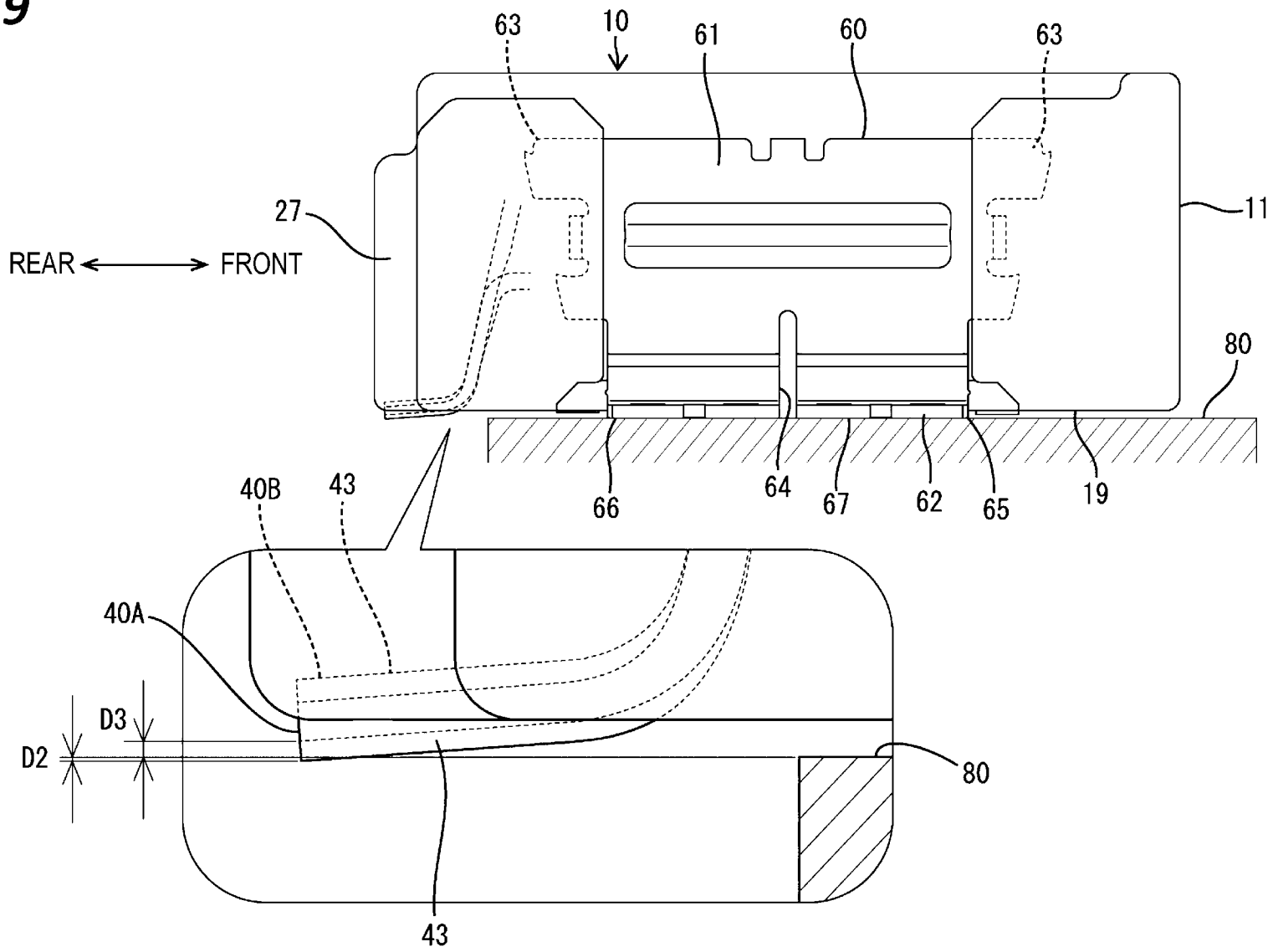
FIG. 9 is a view showing a comparative example in which the measurement of coplanarity is carried out by a method different from that of FIG. 8.

A connector 10 of a surface mount type to be mounted on a surface of a board 100 (printed circuit board) is illustrated in this embodiment. As shown in FIGS. 1 and 2, the connector 10 includes a housing 11, a plurality of terminals 40A, 40B to be mounted into the housing 11, and fixing members 60 to be mounted into the housing 11. The housing 11 is connectable to an unillustrated mating connector. Note that, in the following description, a surface of the connector 10 facing the mating connector at the start of connection of the connector 10 to the mating connector is referred to as a front side concerning a front-rear direction. A right side in FIGS. 7 to 9 is a front side. A surface side of the board 100 is referred to as an upper side concerning a vertical direction. An upper side of each figure except FIG. 6 is an upper side. A width direction is synonymous with a lateral direction and based on a lateral direction in each of FIGS. 3 to 6.

<Housing>

Figure 3:
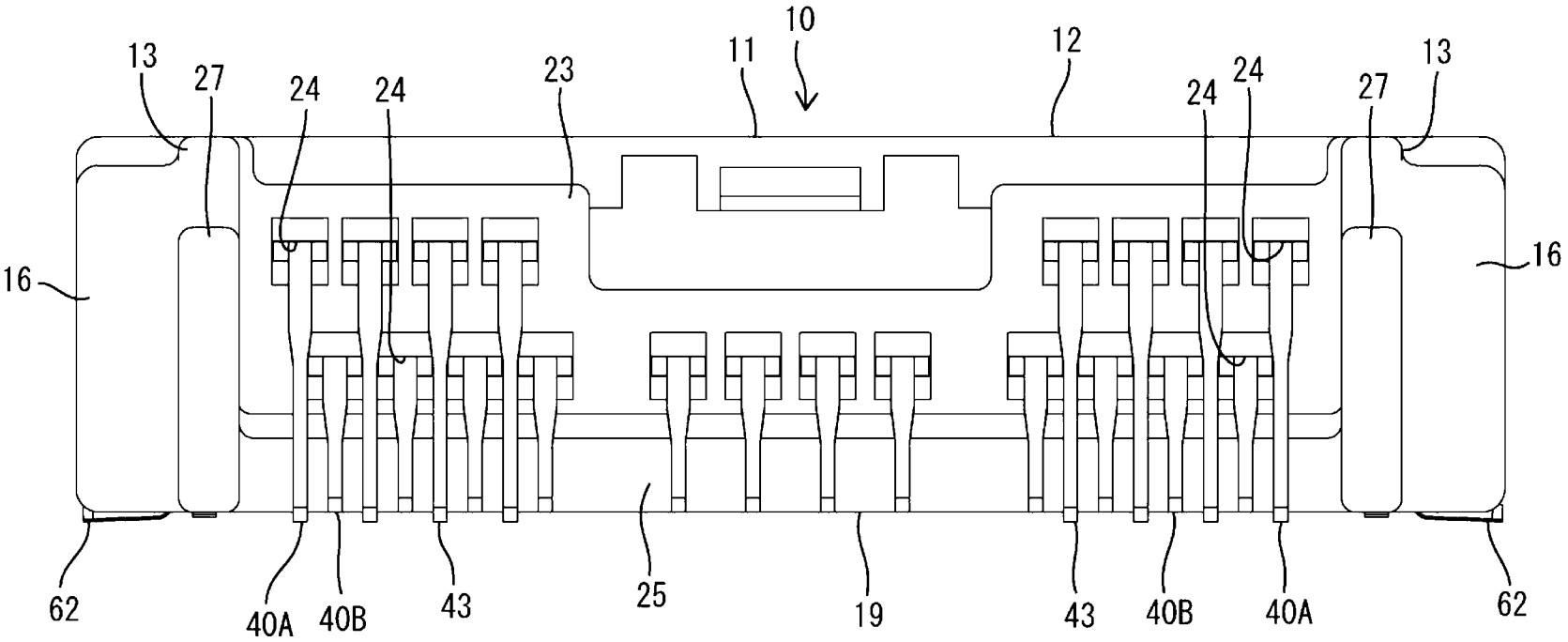
FIG. 3 is a back view of the connector.

The housing 11 is made of synthetic resin and includes a receptacle 12 in the form of a laterally long rectangular tube. The mating connector is fit into the receptacle 12. As shown in FIGS. 1 to 3, the receptacle 12 includes side walls 13 on both left and right ends. As shown in FIG. 2, each side wall 13 is provided with a mounting groove 14. The fixing member 60 is press-fit and mounted into the mounting groove 14 of each side wall 13 from above.

The mounting groove 14 is provided between a front side wall 15 arranged on a front side and a rear side wall 16 arranged on a rear side in the outer surface of the side wall 13. As shown in FIGS. 2 and 7, the mounting groove 14 is defined by a groove back part 17 vertically arranged on the outer surface of the side wall 13 and groove side parts 18 open in edge parts of the front and rear side walls 15, 16 facing each other.

As shown in FIG. 6, the receptacle 12 has a flat bottom surface 19 (also a bottom surface 19 of the housing 11) as a whole. Front projections 21 and rear projections 22 are provided to project downward at front and rear positions near front and rear end parts of the respective mounting grooves 14 on the bottom surface 19 of the receptacle 12. The front and rear projections 21, 22 are in the form of flat rectangular columns, and the lower end surfaces thereof are formed to be flat. As shown in FIG. 7, a projection dimension of the front projections 21 from the bottom surface 19 of the receptacle 12 is larger than that of the rear projections 22 projecting from the bottom surface 19 of the receptacle 12. The lower end surfaces of the front projections 21 are located at the lowermost end of the housing 11.

As shown in FIGS. 1 to 3, the receptacle 12 includes a back wall 23 long in the lateral direction between the respective side walls 13 in a rear part. The back wall 23 is provided with a plurality of press-fit holes 24 penetrating in the front-rear direction. A plurality of press-fit holes 24 are provided side by side in the width direction in two upper and lower stages in the back wall 23. The press-fit holes 24 adjacent in the vertical direction are shifted by half the interval in the width direction. The terminals 40A, 40B are press-fit and mounted into the press-fit holes 24 of the receptacle 12 from behind. Although described in detail later, the terminal 40A, 40B includes a lead portion 41 pulled out rearward from the back wall 23.

The receptacle 12 includes a plate-like protruding portion 25 protruding rearward from a lower end part of the back wall 23. The protruding portion 25 extends long in the lateral direction and both ends thereof are integrally coupled to the respective side walls 13. Further, protection walls 27 for protecting the lead portions 41 of the respective terminals 40A, 40B are provided to project rearward on the respective side walls 13.

<Terminals>

The terminals 40A, 40B are made of conductive metal and shaped to extend long from front ends to rear ends as shown in FIG. 2. In the case of this embodiment, the terminals include a plurality of types of terminals having different lengths, specifically, two types of long and short terminals 40A, 40B.

As shown in FIG. 2, the terminal 40A, 40B includes a mate connecting portion 42 extending rearward from the front end and the lead portion 41 bent from the mate connecting portion 42 to extend downward. Further, the lead portion 41 includes a board connecting portion 43 bent from the lower end thereof to extend rearward and reach the rear end. The board connecting portion 43 is connected to an unillustrated conductive portion formed on the surface of the board 100 by soldering.

The mate connecting portion 42 includes a pair of locking portions 44 protruding leftward and rightward at a position near the lead portion 41. The locking portions 44 of the mate connecting portion 42 are locked in the press-fit hole 24 of the back wall 23. A part of the mate connecting portion 42 forward of the locking portions 44 projects into the receptacle 12 and is connected to an unillustrated mating terminal mounted in the mating connector. In the case of this embodiment, each terminal 40A, 40B is mounted through the back wall 23 by press-fitting the mate connecting portion 42 into the press-fit hole 24 of the back wall 23 from behind after the mate connecting portion 42 and the lead portion 41 are bent in advance.

Figure 4:
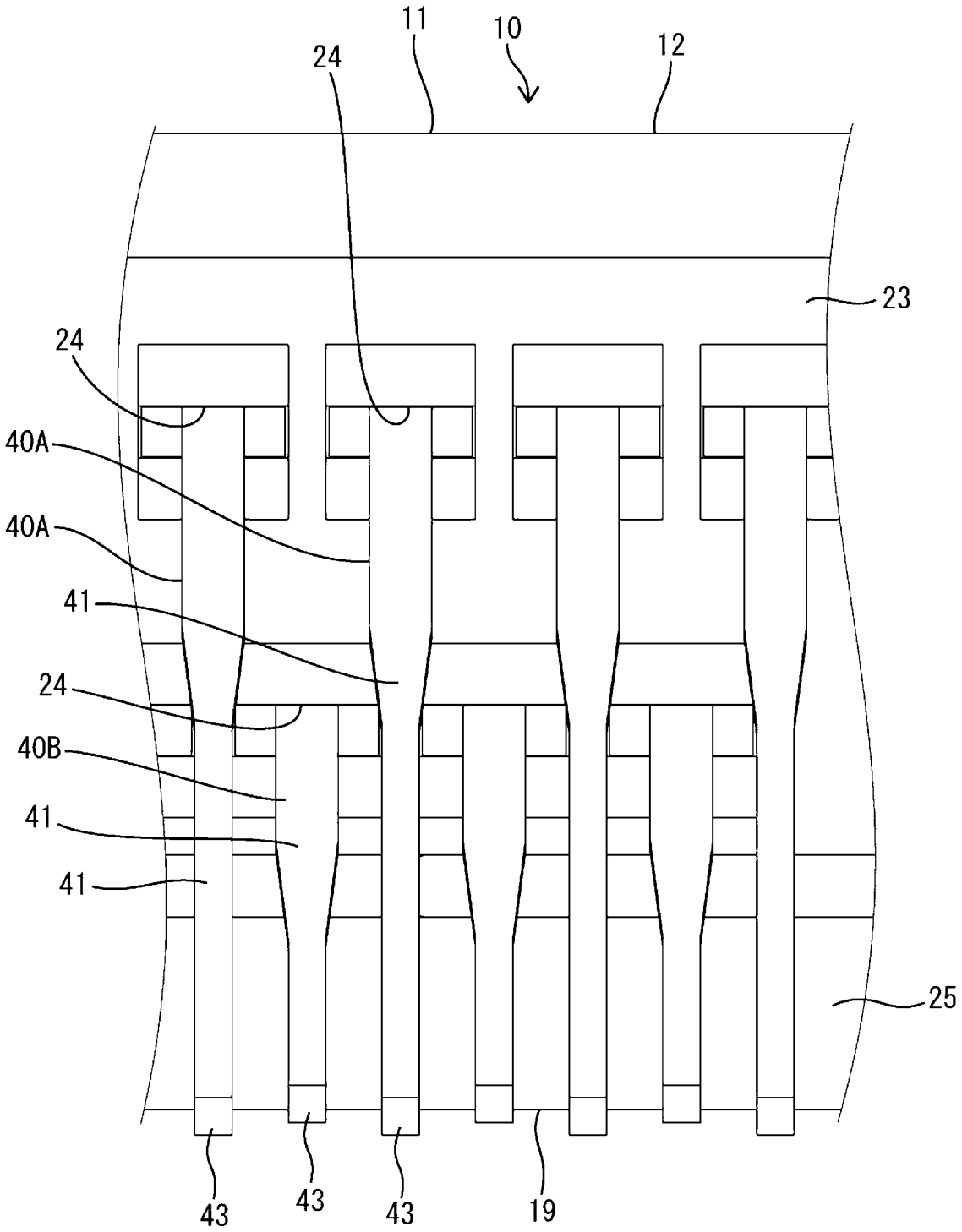
FIG. 4 is a partial enlarged view of FIG. 3.
Figure 5:
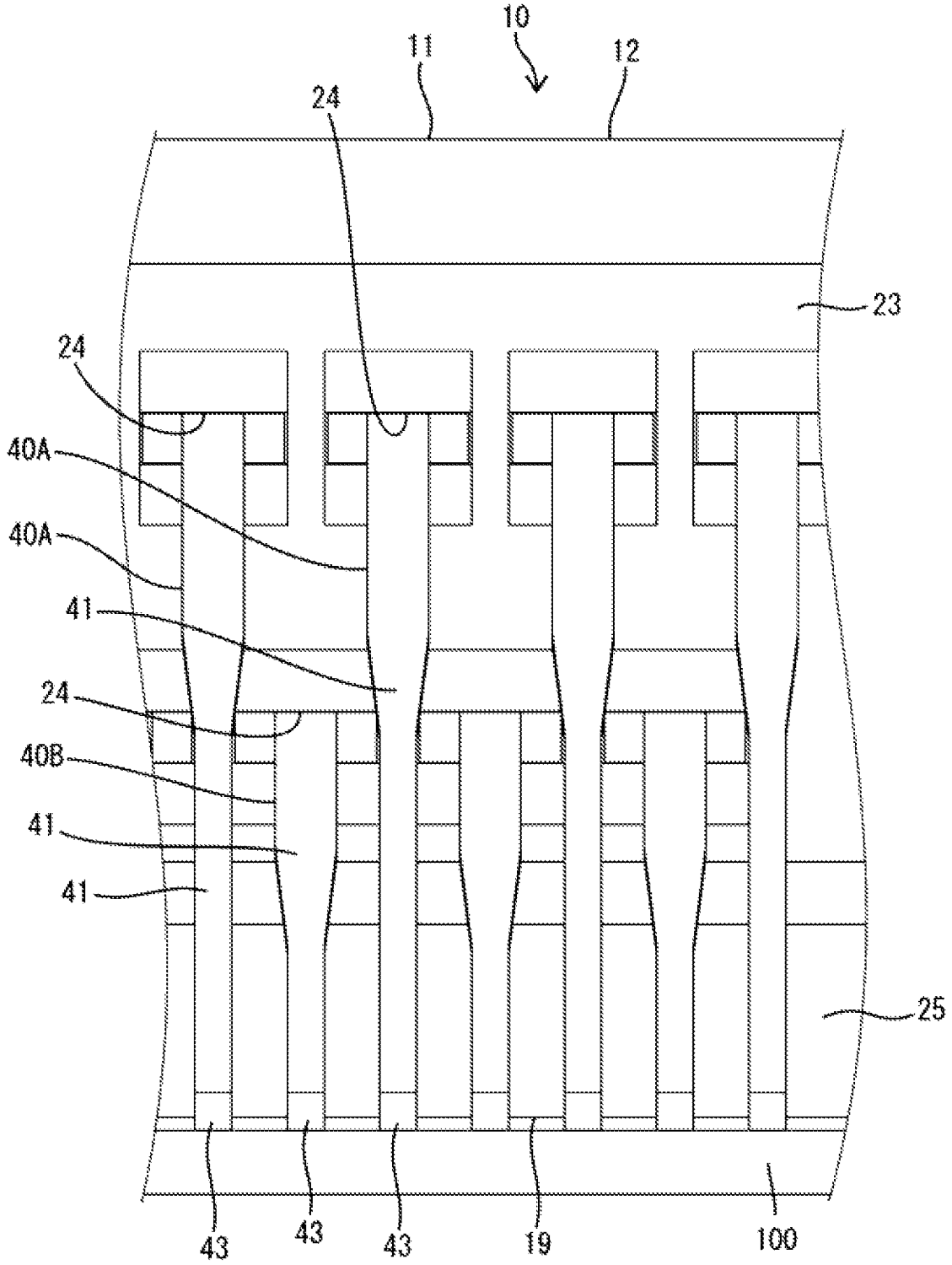
FIG. 5 is a view, corresponding to FIG. 4, of the connector mounted on a board.

As shown in FIGS. 3 to 5, out of the two types of long and short terminals 40A, 40B, the long terminals are upper-stage terminals 40A, the locking portions 44 of which are locked in the press-fit holes 24 arranged in the upper stage of the back wall 23. The short terminals are lower-stage terminals 40B, the locking portions 44 of which are locked in the press-fit holes 24 arranged in the lower stage of the back wall 23.

With the respective upper-stage and lower-stages terminals 40A, 40B mounted through the back wall 23, the rear ends of the board connecting portions 43 of the respective upper-stages terminals 40A and those of the board connecting portions 43 of the respective lower-stage terminals 40B are aligned at the same position in the front-rear direction as shown in FIG. 6. Thus, the respective conductive portions formed on the surface of the board 100 are also arranged side by side in a row in the lateral direction, whereby the enlargement of the board 100 in the front-rear direction can be avoided.

Further, with the respective upper-stage and lower-stages terminals 40A, 40B mounted in the housing 11, the lower ends (rear ends in the case of this embodiment) of the board connecting portions 43 of the respective upper-side terminals 40A are arranged to be lower than those (similarly, rear ends in the case of this embodiment) of the board connecting portions 43 of the respective lower-side terminals 40B as shown in FIG. 4. Since the respective upper-stage and lower-stages terminals 40A, 40B are mounted through the back wall 23 while being shifted by half the interval in the width direction, a height difference between the lower ends of the board connecting portions 43 of the respective upper-side terminals 40A and those of the board connecting portions 43 of the respective lower-side terminals 40B alternately appears in the width direction in a back view. Note that, as shown in FIGS. 8 and 9, the board connecting portions 43 of the upper-side terminals 40A are located to be lower than the board connecting portions 43 of the lower-side terminals 40B without limitation to the lower ends.

The height difference between the board connecting portions 43 of the respective upper-side terminals 40A and the board connecting portions 43 of the respective lower-side terminals 40B is set to correspond to a deformation amount of the housing 11 when the housing 11 is deformed by heat during reflow soldering and warped as described later.

<Fixing Members>

The fixing member 60 is a plate member made of metal and includes, as shown in FIG. 2, a housing mounting portion 61 to be mounted into the housing 11 and a board fixing portion 62 to be fixed to the board 100 by soldering. The housing mounting portion 61 is inserted into the mounting groove 14 of the side wall 13 from above with plate surfaces facing in the lateral direction, and arranged along the groove back part 17 of the mounting groove 14. The housing mounting portion 61 includes locking projections 63 protruding toward both left and right sides. Each locking projection 63 is locked in the groove side part 18 of the mounting groove 14 of the side wall 13.

The board fixing portion 62 is bent from the lower end of the housing mounting portion 61 and projects laterally (leftward when the housing mounting portion 61 is mounted into the mounting groove 14 of the left side wall 13, rightward when the housing mounting portion 61 is mounted into the mounting groove 14 of the right side wall 13). With the housing mounting portion 61 mounted in the mounting groove 14 of the housing 11, a lower surface 67 of the board fixing portion 62 is located below the bottom surface 19 of the housing 11 as shown in FIGS. 3, 8 and 9.

As shown in FIGS. 6 to 9, the board fixing portion 62 is divided into front and rear sections by a slit 64 formed in a central part in the front-rear direction. The slit 64 is formed from the board fixing portion 62 to a lower part of the housing mounting portion 61.

As shown in FIGS. 8 and 9, the board fixing portion 62 has a rectangular shape extending long in the front-rear direction across the slit 64 in a side view and includes a right-angled front end corner portion 65 at a corner part on a front end lower side and a right-angled rear end corner portion 66 at a corner part on a rear end lower side. The lower surface 67 of the board fixing portion 62 is arranged to be continuous in the front-rear direction between the front and rear end corner portions 65 and 66. The lower surface 67 of the board fixing portion 62 is a surface to which solder is attached, and arranged to face the surface of the board 100. With the lower surface 67 of the board fixing portion 62 horizontally arranged, the front and rear end corner portions 65, 66 are arranged at the same height in the vertical direction.

<Measurement of Coplanarity>

As shown in FIG. 8, coplanarity is equivalent to a height difference between a minimum value (lower limit position) of the board connecting portions 43 of the respective upper-stage terminals 40A and a maximum value (upper limit position) of the board connecting portions 43 of the respective lower-stage terminals 40B on the basis of a height of a flat surface 80 with the connector 10 placed on the flat surface 80 of a base.

Here, the minimum value of the board connecting portions 43 of the respective upper-stage terminals 40A is set to be the same as the height of the flat surface 80 and the same as the height of the front end corner portion 65 of each fixing member 60. That is, the height of the front end corner portion 65 of each fixing member 60 serves as a reference in measuring coplanarity.

The front end corner portion 65 of each fixing member 60 is arranged to be lower than the rear end corner portion 66 so that the height of the front end corner portion 65 of each fixing member 60 serves as a reference in measuring coplanarity. In this embodiment, the housing mounting portion 61 of the fixing member 60 is mounted in an inclined posture into the mounting groove 14 of the housing 11 in the vertical direction, whereby the front end corner portion 65 is arranged to be lower than the rear end corner portion 66.

Specifically, as shown in FIG. 7, the housing 11 is placed on a horizontal support surface 90. The housing 11 is supported on the support surface 90 in a posture inclined downward toward a rear side with the lower end surfaces of the front projections 21 and the lower end surfaces of the rear projections 22 held in contact with the support surface 90. Subsequently, the housing mounting portion 61 of the fixing member 60 is perpendicularly inserted into the mounting groove 14 of the housing 11 from above. In this way, the fixing member 60 is mounted in an inclined posture into the mounting groove 14 of the housing 11 in the vertical direction as a whole. That is, the fixing member 60 is mounted into the housing 11 in a posture inclined downward toward a front side due to a height difference between the front projections 21 and the rear projections 22.

With the respective fixing members 60 press-fit and mounted in the respective mounting grooves 14 of the housing 11 and the respective upper-stage terminals 40A and the respective lower-stage terminals 40B press-fit and mounted in the respective press-fit holes 24 of the housing 11, the connector 10 is placed on the flat surface 80 and coplanarity is measured.

Specifically, when the connector 10 is placed on the flat surface 80 as shown in FIG. 8, the connector 10 is supported on the flat surface 80 with the front end corner portions 65 of the respective fixing members 60 and the lower ends (lower ends indicating the minimum value) of the board connecting portions 43 of the respective upper-stage terminals 40A held in point or line contact with the flat surface 80. Parts of the connector 10 except the front end corner portions 65 of the respective fixing members 60 and the board connecting portions 43 of the respective upper-stage terminals 40A are arranged not to contact the flat surface 80. Thus, a state where the lower ends of the board connecting portions 43 of the respective upper-stage terminals 40A and the flat surface 80 are located at the same height is realized. Therefore, coplanarity can be easily calculated by measuring a distance D1 from the flat surface 80 to the lower ends of the board connecting portions 43 of the lower-stage terminals 40B. Coplanarity may be so controlled that the distance D1 is in a predetermined range.

In contrast, as a comparison, a distance D2 from the flat surface 80 to the lower ends of the board connecting portions 43 of the upper-stage terminals 40A and a distance D3 from the flat surface 80 to the lower ends of the board connecting portions 43 of the lower-stage terminals 40B are respectively measured and coplanarity is calculated by subtracting or adding the respective measurement values when the lower surfaces of the board fixing portions 62 of the respective fixing members 60 are in surface contact with the flat surface 80 and the board connecting portions 43 of the respective upper-stage terminals 40A and the board connecting portions 43 of the respective lower-stage terminals 40B are arranged to project rearward from the flat surface 80 as shown in FIG. 9. In this case, the measurement of coplanarity is cumbersome and accuracy may be reduced.

In that respect, if the front end corner portions 65 of the fixing members 60 and the board connecting portions 43 of the upper-stage terminals 40A are in contact with the flat surface 80 as shown in FIG. 8 and the front end corner portions 65 of the fixing members 60 serve as a reference in measuring coplanarity, the measurement of coplanarity is easy and accuracy can be enhanced.

<Reflow Mounting>

The connector 10 is mounted on the board 100 by reflow soldering. Specifically, the board fixing portions 62 of the respective fixing members 60 and the board connecting portions 43 of the respective terminals 40A, 40B are placed on solder paste formed on the surface of the board 100, and solder is cooled and solidified after being melted in an unillustrated reflow furnace. In this way, the board fixing portions 62 of the respective fixing members 60 are fixed to the board 100 by soldering and the board connecting portions 43 of the respective terminals 40A, 40B are connected to the conductive portions of the board 100 by soldering.

If the housing 11 is heated in the reflow furnace, a laterally central part of the housing 11 is deformed to be curved upward. If the housing 11 is warped in this way, the board connecting portions 43 of the respective upper-stage terminals 40A are displaced more upward than the board connecting portions 43 of the respective lower-stage terminals 40B since the respective upper-stage terminals 40A are mounted above the lower-stage terminals 40B in the housing 11.

In the case of this embodiment, the board connecting portions 43 of the respective upper-stage terminals 40A are located to be lower than the board connecting portions 43 of the respective lower-stage terminals 40B in advance in anticipation of upward displacements of the board connecting portions 43 of the respective upper-stage terminals 40A (see FIG. 4). Thus, after reflow soldering is completed, the board connecting portions 43 of the respective upper-stage terminals 40A and the board connecting portions 43 of the respective lower-stage terminals 40B can be aligned at the same height as shown in FIG. 5. As a result, a state where both the board connecting portions 43 of the respective upper-stage terminals 40A and the board connecting portions 43 of the respective lower-stage terminals 40B are satisfactorily soldered to the conductive portions of the board 100 can be realized and the occurrence of solder non-wetting can be suppressed.

As described above, according to this embodiment, the board connecting portions 43 of the respective upper-stage terminals 40A are set to be located lower than the board connecting portions 43 of the respective lower-stage terminals 40B in anticipation of the deformation amount of the housing 11 caused by heat during reflow soldering. Thus, after reflow soldering, the board connecting portions 43 of the respective upper-stage terminals 40A and the board connecting portions 43 of the respective lower-stage terminals 40B can be aligned at the same height. Therefore, variation of coplanarity can be suppressed.

Particularly, in the case of this embodiment, since the state where the front end corner portions 65 of the respective fixing members 60 and the board connecting portions 43 of the respective upper-stage terminals 40A are in contact with the flat surface 80 can be realized when the connector 10 is placed on the flat surface 80 in measuring coplanarity, coplanarity can be properly controlled on the basis of the flat surface 80 having the same height as the front end corner portions 65 of the respective fixing members 60.

Further, each fixing member 60 is so mounted into the housing 11 that the front end corner portion 65 is separated more from the bottom surface 19 of the housing 11 than the rear end corner portion 66. Thus, when the connector 10 is placed on the flat surface 80, a state where the front end corner portion 65 of each fixing member 60 is in contact with the flat surface 80 and the rear end corner portion 66 thereof is separated from the flat surface 80 can be realized with good reliability.

Furthermore, in the case of this embodiment, the front projections 21 and the rear projections 22 are respectively provided before and after the mounting grooves 14 on the bottom surface 19 of the housing 11, and the front projections 21 are provided to project more from the bottom surface 19 of the housing 11 than the rear projections 22. Thus, if the housing mounting portion 61 of the fixing member 60 is press-fit into the mounting groove 14 of the housing 11 from above, the fixing member 60 can be automatically mounted in the posture inclined downward toward the front side due to the height difference between the front and rear projections 21, 22 and the fixing member 60 needs not be specially processed.

Other Embodiments of Present Disclosure

The embodiment disclosed this time should be considered illustrative in all aspects, rather than restrictive.

Although the terminals are arranged in two upper and lower stages in the housing in the case of the above embodiment, terminals may be arranged in three or more stages in the vertical direction in the housing as another embodiment. For example, if upper-stage terminals, middle-stage terminals and lower-stage terminals are successively mounted from an upper stage in the housing, board connecting portions of the upper-stage terminals, board connecting portions of the middle-stage terminals and board connecting portions of the lower-stage terminals may be set to be located lower in this order in a state before reflow soldering.

Although the fixing member is mounted into the housing in the posture inclined with respect to the vertical direction due to the high difference between the front projection and the rear projection in the case of the above embodiment, a fixing member may be perpendicularly mounted into the housing in the vertical direction and may be so formed in advance that a front end corner portion is located to be lower than a rear end corner portion as another embodiment.

Although the front and rear end corner portions of the fixing member have a right-angled shape in the case of the above embodiment, front and rear end parts of a fixing member may have a rounded shape as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector to be mounted on a surface of a board, comprising:

a housing; and a plurality of terminals arranged in two or more stages in a vertical direction in the housing, wherein:

the plurality of terminals extend downward behind the housing and include a plurality of board connecting portions in lower end parts of the plurality of terminals, respectively, the plurality of terminals includes:

a plurality of upper-stage terminals provided in an upper stage in the housing, and including a plurality first board connecting portions in lower end parts, respectively; and a plurality of lower-stage terminals provided in a lower stage at an height lower than the upper stage in the housing, and including a plurality second board connecting portions in lower end parts, respectively, and the plurality of first board connecting portions, among the plurality of board connecting portions, are provided at an height lower than the plurality of the second board connecting portions before the plurality of board connecting portions are connected to the surface of the board the board connecting portions.

2. The connector of claim 1, further comprising:

plate-like fixing members fixed to the board, wherein:

a pair of the fixing members are mounted on both widthwise sides of the housing and each includes a front end corner portion at a corner part on a front end lower side and a rear end corner portion at a corner part on a rear end lower side, and when the connector is placed on a flat surface before being mounted on the board, the connector is supported on the flat surface with the front end corner portions of the pair of fixing members and the board connecting portions provided in the terminals arranged in an uppermost stage in the housing held in contact with the flat surface.

3. The connector of claim 2, wherein the front end corner portions are separated more downward from a bottom surface of the housing than the rear end corner portions in the pair of fixing members.

4. The connector of claim 3, wherein:

the housing is provided with mounting grooves for the fixing members and front projections and rear projections are respectively provided before and after the mounting grooves on the bottom surface of the housing, and the front projections project more from the bottom surface of the housing than the rear projections.

5. The connector of claim 1, the plurality of first board connecting portions and the plurality of second board connecting portions are provided at a substantially same height from each other on the surface of the board after the plurality of board connecting portions are connected to the surface of the board.

* * * * *